United States Patent [19]

Naylor et al.

[11] Patent Number: 4,616,157

[45] Date of Patent: Oct. 7, 1986

[54] INJECTOR FOR NEGATIVE IONS

[75] Inventors: Harry Naylor, Richmond, New Zealand; Kenneth H. Purser, Manchester, Mass.

[73] Assignee: General Ionex Corporation, Newburyport, Mass.

[21] Appl. No.: 759,465

[22] Filed: Jul. 26, 1985

[51] Int. Cl.[4] ..... H01J 7/24

[52] U.S. Cl. ..... 315/111.01; 250/423 R; 313/231.41; 313/359.1

[58] Field of Search ..... 315/111.41, 111.01; 313/231.4, 359; 250/423 R

[56] References Cited

U.S. PATENT DOCUMENTS

| | | | |
|---|---|---|---|
| 2,215,155 | 9/1940 | Kallman | 313/359.1 |
| 2,232,030 | 2/1941 | Kallman | 313/359.1 |
| 2,816,243 | 10/1957 | Herb et al. | 250/423 R |
| 3,617,789 | 11/1971 | Middleton | 250/423 R |
| 4,298,798 | 11/1981 | Huffman | 250/423 R |

*Primary Examiner*—Harold Dixon

*Attorney, Agent, or Firm*—Pearson & Pearson

[57] ABSTRACT

Apparatus for generating negative ions, specifically $He^-$ ions. Positive ions at a predetermined energy level from a conventional ion source are directed to a permanent magnet channel that utilizes two, spaced permanent magnet assemblies to analyze the ions and, with double focusing, to direct them to a focal point located in a lithium vapor canal. As the positive ion beam passes through a lithium vapor of constant density in a predetermined volume at the central region of the canal, electrons transfer to the ions and produce $He^-$ ions. The canal is constructed to efficiently condense and collect lithium vapor as it escapes the predetermined volume. The beam of negative ions then passes to another permanent magnet assembly that corrects any astigmatism in the emerging beam and that directs the beam, with appropriate optical properties, onto an injection axis for another accelerating structure.

10 Claims, 5 Drawing Figures

INJECTOR FOR NEGATIVE IONS

BACKGROUND OF THE INVENTION

This invention is directed to ion injectors and more specifically to injectors for generating negative ions.

A number of injectors are used for producing negative ions. Typically such injectors include a source of positive ions that produces a positive ion beam, separate electromagnets for analyzing and focusing the beam, and a charge conversion apparatus that transfers electrons to the positive ions thereby to convert the positive ions to negative ions. More particularly, such charge conversion apparatus vaporizes some substance, such as lithium, to produce a vapor through which the positive ion beam must pass. As the positive ion beam passes through the vapor, electrons transfer to the ions thereby converting them to negative ions to produce a negative ion beam.

Generally, these injectors include separate deflecting and focusing electromagnets and electrostatic lenses that discretely deflect the ion beam thereby to analyze the beam and that focus the beam at a focal spot in the charge conversion apparatus. The negative ion beam from the conversion apparatus passes through another focusing lens into an accelerating section along an injection path.

As known, the ion beam in such injectors travels in a vacuum. More specifically, such injectors are constructed with vacuum chambers and vacuum pumps to maintain the vacuum. Positive ion sources generally use a gas so that the vacuum pumps must overcome the gas that is admitted to the system from the source. In order to minimize leakage and other sources of gases, prior injectors position the electromagnets or electrostatic lenses externally to the vacuum chamber. This increases the magnetic gap of such devices over that which is really needed to pass the ion beam, and the increase in magnetic gap requires that the electromagnet or electrostatic lenses be bulkier, become more expensive to manufacture due to the increased sizes and concomitant increase in power supply requirements, and, due to increased power requirements, more expensive to operate. In many new applications, however, such characteristics have become unacceptable.

Therefore, it is an object of this invention to provide an improved injector of negative ions.

Another object of this invention is to provide an improved injector of negative ions that is inexpensive to produce.

Still another object of this invention is to provide an improved injector of negative ions that is compact.

Yet another object of this invention is to provide an improved injector of negative ions that is reliable in operation.

SUMMARY OF THE INVENTION

In accordance with this invention, a negative ion injector includes a source that produces a beam of positive ions at a predetermined energy. This ion beam is directed to a magnet channel that uses separated permanent magnets and poles formed with surfaces that form hyperboles of revolution to deflect and strongly focus the positive ion beam at a focal point in a lithium vapor area. The beam passes through the lithium vapor where electrons transfer to the positive ions to produce He−ions. A second set of permanent magnets and pole pieces correct any astigmatism in the negative ion beam and deflect the beam onto an injection axis with the proper optical qualities.

This invention is pointed out with particularity in the appended claims. A more thorough understanding of the foregoing and other objects and advantages of this invention may be better understood by referring to the following description taken in conjunction with the accompanying drawings:

DESCRIPTION OF AN ILLUSTRATIVE EMBODIMENT

Figure 1:
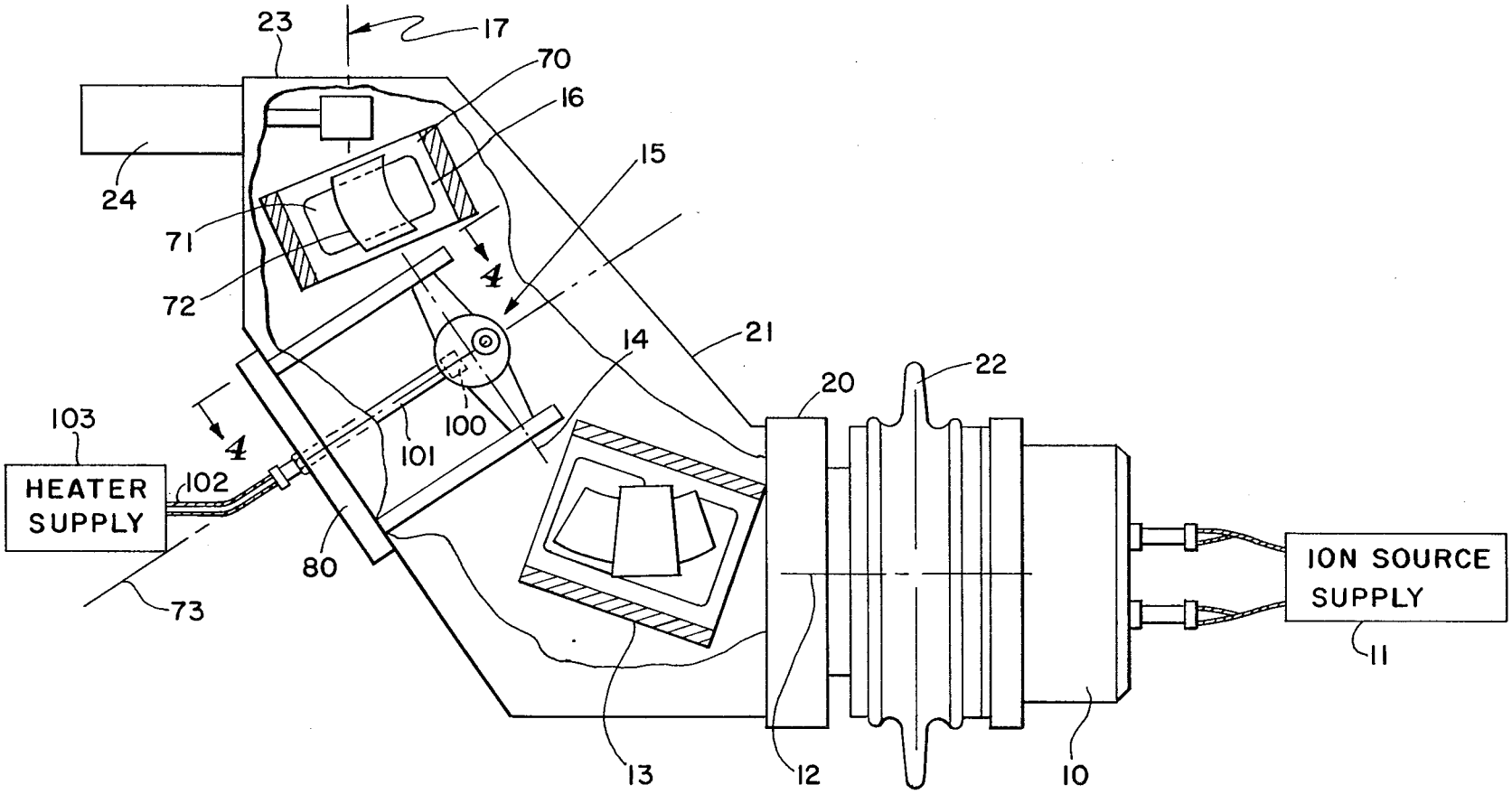
FIG. 1 is a view, partially in section, of an ion injector constructed in accordance with this invention.

FIG. 1 depicts a negative ion injector constructed in accordance with this invention. In general terms, this injector includes a conventional positive ion source 10 energized by a conventional ion source power supply 11. Positive ions from the source 10 travel along an axis 12 toward a permanent magnet assembly 13. The permanent magnet assembly 13 deflects the incoming positive ion beam onto an axis 14 through a lithium canal 15. In addition, the permanent magnet assembly 13 also focuses the ion beam at the center of the lithium canal 15. As the positive ions pass through the lithium canal 15, electrons transfer to the ions thereby to produce negative ions. Another permanent magnet assembly 16 deflects the now negative ion beam onto an injection axis 17. The permanent magnet assembly 16 also removes any astigmatism that has appeared in the ion beam. Typically the negative ion beam on the injection axis 17 transfers to some other type of accelerator to be elevated to a final energy either as a negative or positive ions.

Still referring to FIG. 1, a typical ion source 10 generates He+ ions at a potential determined by the power supply 11. In one specific application to which this invention is directed, the positive ions from the source 10 have an energy of about 20 keV. The ion source is connected mechanically to a flange 20 on a vacuum chamber 21 through a coupling bellows system 22. At an exit port 23 of the vacuum chamber 21, a Faraday cup assembly 24 can be positioned to allow the beam to be intercepted for diagnostic purposes. During normal use, the Faraday cup is retracted to allow the beam to pass without interference.

In accordance with one aspect of this invention, it is possible to construct the ion injector, especially the vacuum chamber 21 in a very compact arrangement. More particularly, the magnet assemblies 13 and 16 are constructed of permanent magnets, so both these assemblies can be located within the vacuum chamber 21. In addition to eliminating the need for the external apparatus of prior injectors, the positioning of the magnet structures inside the vacuum chamber 21 allows more flexibility in the design of the vacuum chamber 21 itself. Further, each of the magnet assemblies 13 and 16 perform two functions that were performed by discrete elements with external electromagnetic or electrostatic lenses. As previously indicated, the magnet assembly 13 deflects the beam onto the axis 14. In addition, it strongly focuses the beam in two planes to a focal point at the center of the lithium canal 15. The beam deflection also analyzes the beam so that only ions of the predetermined energy transfer to the lithium canal 15. Likewise, the magnet assembly 16 deflects the negative ion beam onto the injection axis 17 while simultaneously removing any astigmatism in the beam.

Figure 3:
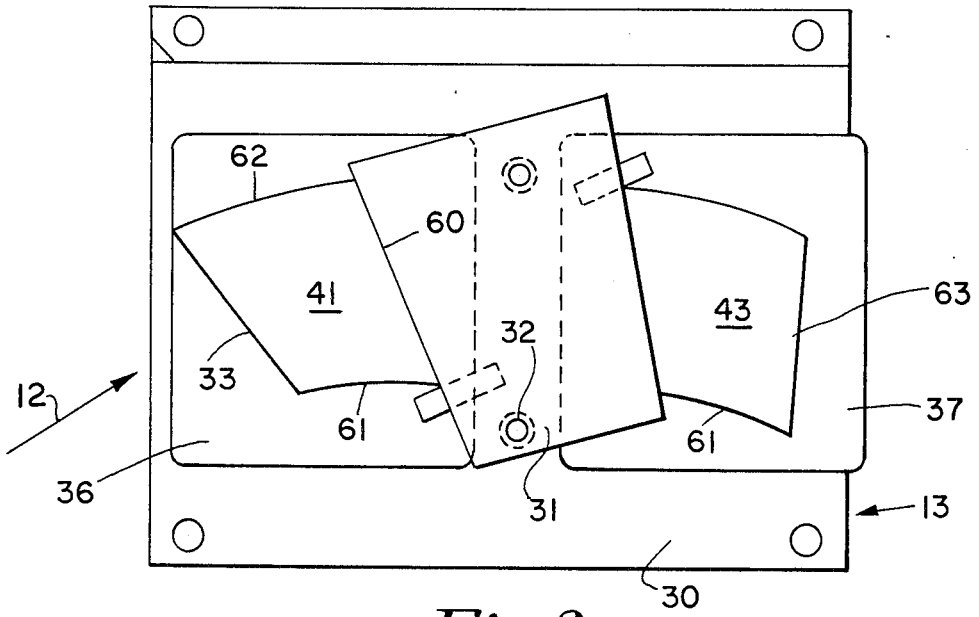
FIG. 3 is a sectional of the first permanent magnet section of the ion injector taken along lines 3—3 in FIG. 2.
Figure 2:
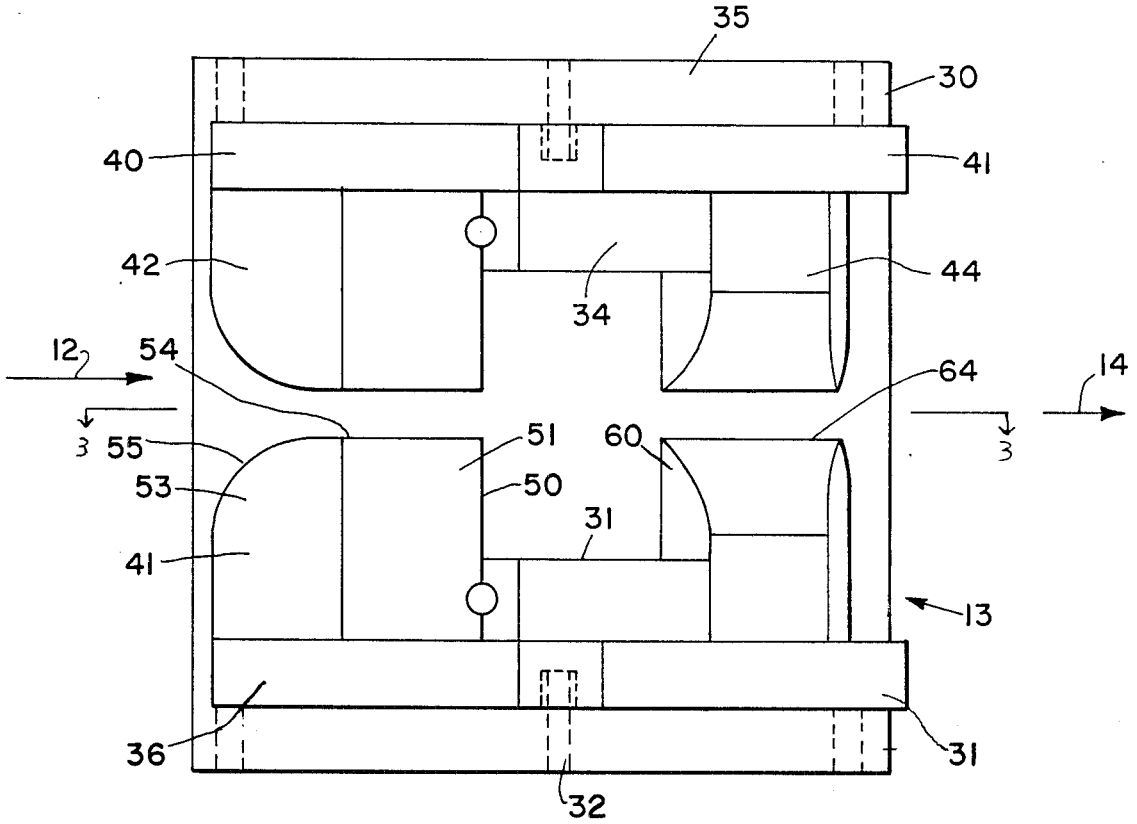
FIG. 2 is view of a first permanent magnet section of the ion injector shown in FIG. 1.

Referring to FIGS. 2 and 3, the permanent magnet assembly 13 includes a rectangular yoke assembly 30. In this particular embodiment, the ion beam is to be deflected about 45° so the yoke is positioned in the vacuum chamber 21 of FIG. 1 to be skewed about one-half that angle from the axis 12. A non-magnetic locating block 31 is positioned by pins 32 on a lower yoke piece 33. A similar locating block 34 is positioned on the upper yoke piece 35. The locating block 31 positions a first permanent magnet 36 and a second permanent magnet 37 against the lower yoke piece 33. The locating block 31 positions similar permanent magnets 40 and 41 against the upper yoke piece 35. These magnets are paired to form two distinct magnetic fields. More particularly, the permanent magnets 36 and 40 are paired, and the permanent magnets 37 and 41 are paired.

A series of pole pieces mounted to the locating blocks 31 and 34 provide the necessary magnetic field profile to accomplish the combined deflection and focusing functions. A first pair of poles 41 and 42 attach to the locating blocks 31 and 34 respectively. As now described, the resulting field from these poles 41 and 42 in the magnetic gap therebetween deflects the ion beam as it passes through the magnetic gap about 22.5° and provides horizontal and vertical focusing. Similarly, a second pair of poles 43 and 44 associated with permanent magnets 37 and 41 deflect the ion beam another 22.5° and provide further horizontal and vertical focusing.

As poles 41 and 42 are mirror images, only pole 41 will be described in detail. Starting first at the locating block 31, the pole 41 has a planar, vertical surface 50 that positions the pole 41 against the locating block 31. A next vertical side 51 is slightly concave while the opposite side 52 is slightly convex. The remaining side 53 is planar. The top surface 54 of pole 41 is curved with an apex at the intersection of sides 50 and 51. This curved surface 55 corresponds to a hyperbole of revolution. Thus, the magnetic gap between the poles 41 and 42 is variable with position. The maximum magnetic gap occurs in the vicinity of the side 52 while the minimum magnetic gap occurs along the side 51.

As shown in FIGS. 1 and 3, the beam axis 12 is not normal to the edge defined by the side 53, rather it is about 20° from the normal. Thus, as the beam enters the magnetic gap defined by poles 41 and 42 it is strongly focused in the horizontal plane. As the beam traverses the magnetic gap defined by the poles 41 and 42, and specifically the fields established by the facing hyperbolic pole surfaces, like the surface 54, the beam deflects and undergoes vertical focusing. As the beam leaves the magnetic gap at the edges formed by surfaces 50, it undergoes vertical focusing. This occurs because the beam is deflected about 15° with respect to a normal from the surface 50.

As the beam is not influenced by other than fringing fields or very weak fields after leaving the area of poles 41 and 42, the beam travels in an essentially straight line until it reaches poles 43 and 44. Referring specifically to pole 43, there is a planar locating surface 60 that abuts the locating block 31. The front and back sides 61 and 62 shown in FIG. 3, are concave and convex respectively while a surface 63, that defines the exit gap of the magnet assembly is planar. The top surface 64, as seen in FIG. 2, also defines a surface described by a hyperbole of revolution, and it is curved such that the magnetic gap between the poles 43 and 44 widens toward the surface 61.

As the beam traverses the edge defined by surfaces 60 in poles 43 and 44, the magnetic field at the edge horizontally focuses the beam. As the beam traverses the magnetic field established across the magnetic gap by the facing hyperbolic pole surfaces, like surface 64, on poles 43 and 44, the beam deflects and undergoes further horizontal focusing. As the beam leaves the magnetic gap at the edges formed by surfaces 63, it undergoes vertical focusing.

Now referring to the magnet assembly 16 shown in FIG. 1, it has a similar construction to the magnet assembly shown FIGS. 2 and 3. Specifically, the magnetic assembly includes a yoke 70, permanent magnets mounted to the yoke and curved pole pieces. One such permanent magnet 71 and pole piece 72 appear in FIG. 1 to define a lower pole. A complementary magnet and pole complete the assembly and define the magnetic gap. The pole pieces define a straight tapered gap such that vertical focusing occurs at each edge while deflection and horizontal focusing occur in the gap. Moreover, this permanent magnet is constructed optically to produce an approximately parallel ion beam at its exit.

Therefore, it can be seen that this ion injector can be constructed without external electromagnetic or electrostatic lenses. The magnet assemblies are located within the vacuum chamber 21, so the vacuum chamber construction can be dependent upon other factors. As a result, the ion injector can be reduced in size. The use of permanent magnets is less expensive than the use of electromagnetic lenses with their large yokes, coils, power supplies and necessary control equipment. The use of permanent magnets in an arrangement of separated bending magnets produces an achromatic bending magnet. Such magnets are characterised in the small changes in energy of the particles does not affect the overall optical characteristics of the lens. Thus, small variations in the energy of the ions from the source 10 have no affect in the position of the beam at the exit of the injection. Finally, the use of permanent magnets increases the reliability of the ion injector over those in which electromagnetic or electrostatic lenses are used because the permanent magnets are inherently reliable.

Figure 4:
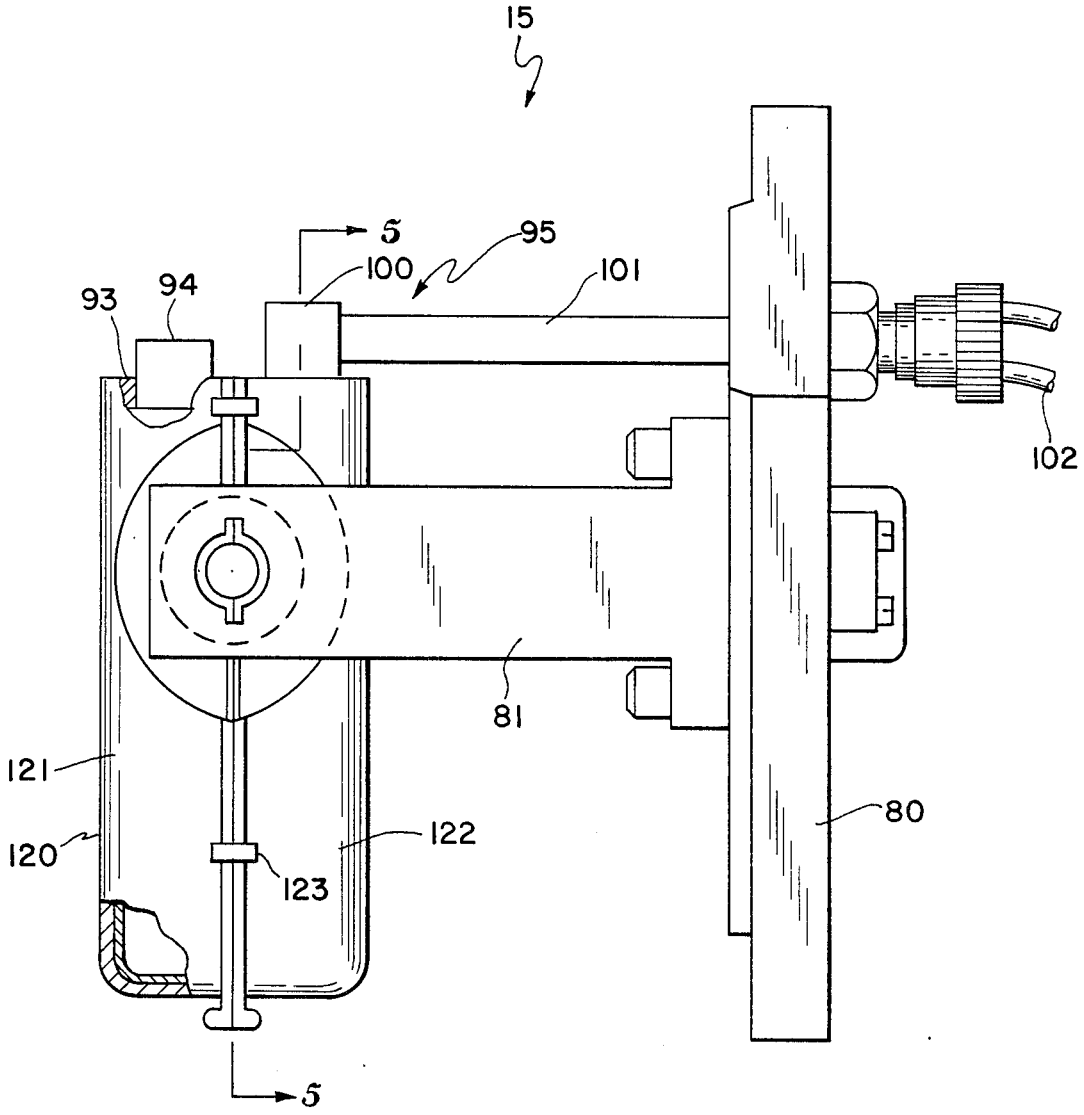
FIG. 4 is a view, partially in section, of a charge conversion apparatus shown in FIG. 1.
Figure 5:
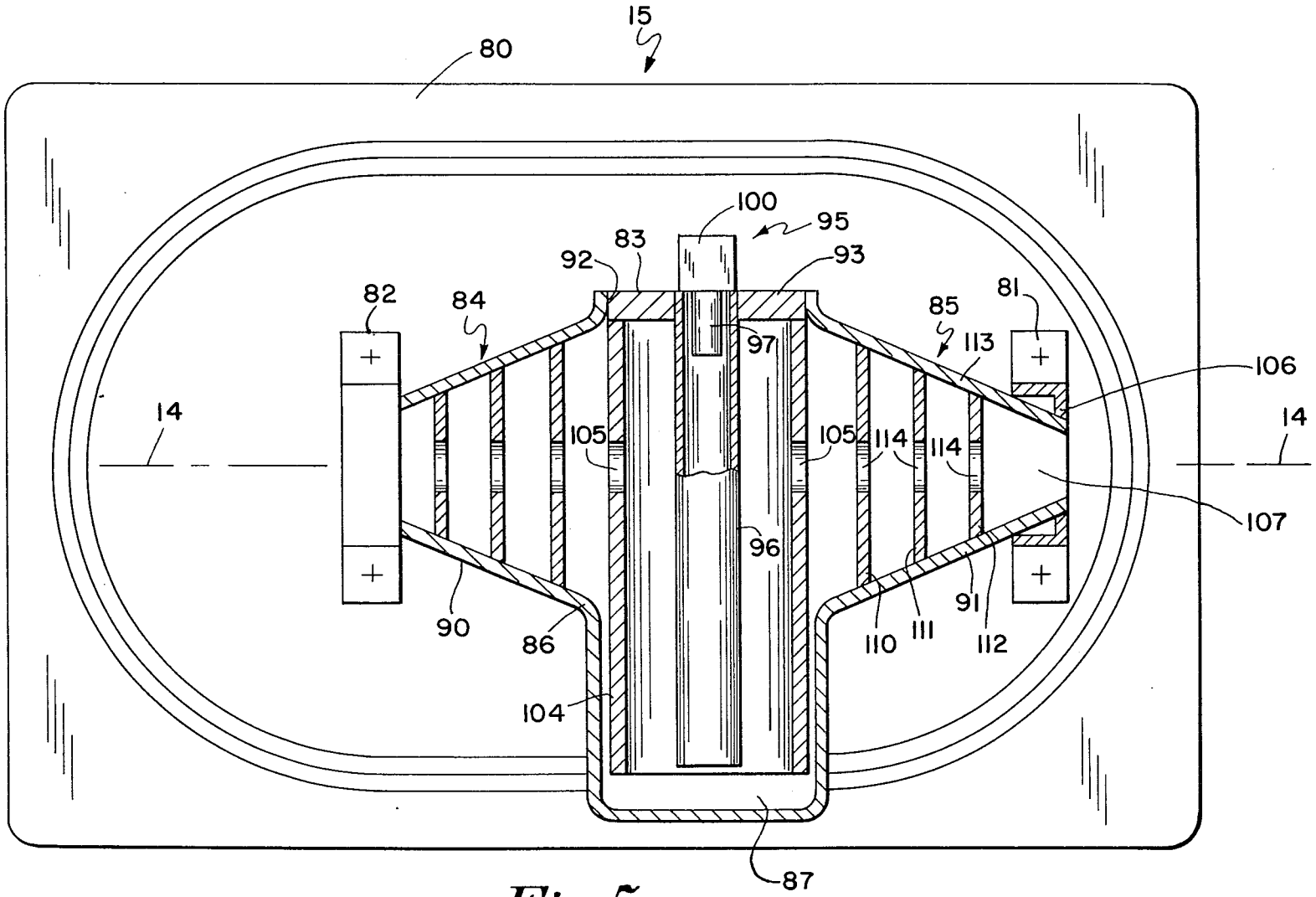
FIG. 5 is a sectional view of the charge conversion apparatus taken along lines 5—5 in FIG. 4.

The lithium canal 15 shown in FIG. 1 is depicted in detail in FIGS. 4 and 5. As shown in these figures, the canal includes a support plate 80 that carries the remaining structure of the canal and that connects with a vacuum-tight seal to the vacuum chamber 21. Two support arms 81 and 82 extend normally from the support plate 80. As described later, these arms 81 and 82, together with the support plate 80, form an essentially constant temperature heat sink for facilitating the operation of the canal 15. A canal structure is suspended between these arms 81 and 82. This structure includes a body portion that defines a vaporizing section 83 and condensing sections 84 and 85. The body portion includes a stainless steel body 86 that forms a well 87, two frustoconical sections 90 and 91 that support the well 87 from the arms 81 and 82, and an upper lip portion 92 that forms an opening. A plug 93 closes this opening. The plug contains two openings. A plug 94 closes one such opening that is a fill hole through which lithium is replenished. The second opening receives a heater structure 95 that includes a tube 96 that extends down into the well 87. A conventional heater 97 is inserted in the tube 96, so the heater 97 is located in the atmosphere, thereby facilitating heat transfer to the tube 96 and eliminating the need for vacuum feedthrough connections. A corner block 100 connects the heater 97 to a conduit 101 that the plate 80 supports. Heater conductors 102 from a heater power supply 103 are carried through the tube 101 and block 100 to the heater 97.

The plug 93 also supports a stainless steel tube 104 that is coaxial and coextensive with the heater 97 and tube 96. Two apertures 105 are formed through the walls of this tube and are aligned with the beam axis 14 thereby to allow the beam to pass through tube 104. When the heater 97 is energized, heat is conducted through the tube 96 into the lithium in the well 87. The lithium then is vaporized and fills the area defined by the tube 104. This structure during controlled heating becomes essentially isothermal within the confines of the tube 87, so the partial pressure and density of the lithium vapor within the confines of the tube 104 are constant. As the positive ion beam passes through this area within the tube 114, electrons transfer from the vapor to the ions thereby converting them to negative ions.

As shown in FIG. 5, the ends of the condensing sections 84 and 85 rest in supports, such as the support 106 shown on arm 81. Moreover, the ends of the condensing sections constitute open ports 107 that contain no vacuum windows. Thus, lithium vapor at its partial pressure will try to migrate to the vacuum area outside the canal 15. The condensing sections 84 and 85 minimize any escape of the vapor or condensed lithium, however. Looking specifically at the condensing section 85, it contains a number of parallel baffles, in this particular embodiment three baffles 110, 111, and 112 of decreasing diameter that fit within the frusto-conical wall section 113 of the body 86. Each of these baffles is formed with a central aperture 114 centered on the beam axis, again to allow the beam to pass through the canal without interference. The portions 113 of the body 86 also are copper clad to improve their conductivity.

During operation, some lithium vapor will escape through the apertures 105 into the condensing sections 84 and 85. The construction of these sections, however, establishes a uniform temperature gradient between the tube 104 and the supports 81 and 82. Particularly, the copper cladding on the sections 113 assures the maintenance of a controlled temperature gradient to the heat sink formed by the arms 80 and 81 and the plate 80. Thus, the temperature of the baffles also changes under control with the baffle 110 having the highest temperature and the baffle 112 having the lowest temperature. This controlled temperature gradient defines a series of condensing surfaces that the escaping lithium vapor can contact. When the canal is installed, it is oriented vertically as shown in FIG. 4 so that the well 87 is at the lowest point. As the vapor condenses, gravity causes the condensate to drain down the baffles and to pass through drain holes, not shown, in the baffles and down the body 86 into the well. From inspection, it will be seen that the aperture diameter and solid angle from the interior of the tube through the apertures 105 and 114 to the vacuum and heat sink temperature are very small. Thus, the proportion of vapor escaping outside the canal 15, as defined by the body 86, is very small. Reductions of 100:1 should be possible. This reduces the consumption of lithium, and particularly reduces the number of times equipment using the ion injector has to be turned off in order to refill lithium.

The canal 15 is completed, by installing the support arms 81 and 82 and the body 86 inside a pressed metal housing 120 that comprises two housing halves 121 and 122. A series of clips 123 keep the halves together. This housing acts as a heat shield and provides a constant temperature enclosure for the canal 15.

Another advantage of this canal can be seen by looking at FIG. 1. The ion beam from the ion source 10 is bent 45° to the canal 15. Lithium that leaves through the relatively small window formed by the apertures 105, 107 and 114 will not reach the ion source on a first path within the limits of those apertures. The amount of lithium vapor that will reach the ion source is insignificant. Similarly, the amount of lithium vapor reaching the exit 23 of the injector will be insignificant. This greatly increases the stability and reliability of the ion source 10 and any accelerator connected to the injector.

There has been described a single embodiment of this invention. However, many variations can be made to this embodiment without departing from the spirit and scope of this invention. Different magnetic properties can be used to produce ion injectors with slightly different optical properties. The particular vacuum chamber structure is dictated by the end application for the ion injector; other structures are possible. The canal has been described with respect to lithium, but the structure, with appropriate modifications, is also applicable to other materials such as sodium and magnesium. Different configurations of the body and baffle constructions can be used. Therefore, it is the object of the appended claims to cover all such variations as come within the true spirit and scope of this invention.

What is claimed as new and desired to be secured by Letters Patent of the United States is:

1. An injector for negative ions at a predetermined energy level along an injection axis, said injector comprising:

A. ion source means for producing He+ ions,

B. vacuum chamber means connected to said ion source for providing a vacuum environment through which the ions pass, C. vapor canal means in said vacuum chamber for producing charge exchange vapor in a contained space, D. first permanent magnet means in said vacuum chamber for deflecting the He+ ions from said ion source means onto an axis through said vapor and for focusing the positive ion beam to a focal point in the vapor, the vapor transferring electrons to said ions to produce He− ions, E. second permanent magnet means in said vacuum chamber at the exit of said canal means for focusing said He− ions and deflecting the negative ions onto the injection axis, F. power supply means connected to said ion source for elevating the energy of said ions to the predetermined energy level.

2. A negative-ion injector as recited in claim 1 wherein said canal means includes:

i. a supporting structure, ii. a housing with a central portion having barriers thereby to form a substantially isothermal volume and apertures in the wall thereof through which the ion beam passes, iii. a reservoir at the bottom of said central portion for accumulating the converting material in the liquid state, iv. heater means located in the central portion for vaporizing the converting material, v. thermally conductive conical sections extending from said central region thereby to produce a thermal gradient to a supporting structure, and vi. a plurality of transverse baffles within said conical sections, each having an aperture aligned on the beam axis for condensing the vapor, the liquid returning to the reservoir through gravity.

3. A negative-ion injector as recited in claim 2 wherein said interior portions of said canal are exposed to vacuum conditions and wherein said heater means includes a tube located in said portion extending into the reservoir, said tube being sealed to said central portion to form a vacuum barrier, and a heater assembly located in said tube whereby said heater assembly is external to the vacuum and heat is conducted through the tube into the reservoir.

4. A negative-ion injector as recited in claim 2 wherein said thermally conductive conical sections are composed of a copper-clad material.

5. A negative ion injector as recited in claim 2 wherein said conical sections are formed as frusto-conical sections.

6. A negative ion injector as recited in claim 1 wherein each said permanent magnet means includes a yoke with first and second parallel sections, first and second permanent magnets affixed to said first and second yoke sections respectively, and first and second pole pieces connected to said first and second permanent magnets thereby to define a magnetic gap therebetween.

7. A negative ion injector as recited in claim 6 wherein said pole pieces define edge fields that focus the ion beam.

8. A negative ion injector as recited in claim 1 wherein said first permanent magnet means includes first and second magnet assemblies, said magnet means including:

i. yoke means, ii. first and second sets of permanent magnets mounted on said yoke means in a spaced relationship, iii. first and second pole means mounted to said first and second sets of permanent magnets thereby to form two, separated magnetic gaps through which the ion beam passes, iv. said first magnetic assembly having an entrance edge inclined to the beam for focusing horizontally, an exit edge inclined to the beam for focusing the beam vertically and pole surfaces for focusing the beam vertically, and v. said second magnetic assembly having an entrance and exit edges inclined to the beam for focusing vertically and pole surfaces for focusing the beam horizontally.

9. A negative ion injector as recited in claim 8 additionally comprising locating blocks connected to said yoke means for separating and locating said first and second sets of permanent magnets.

10. A negative ion injector as recited in claim 8 wherein said pole means have pole surfaces that corresponding to hyperbole of revolution.

* * * * *